US008156688B2

(12) United States Patent
Tan

(10) Patent No.: US 8,156,688 B2
(45) Date of Patent: Apr. 17, 2012

(54) CLIP AND FRAME ASSEMBLY AND COMPONENTS THEREOF

(75) Inventor: Kok Boon Tan, Singapore (SG)

(73) Assignee: Preference Manufacturing (Aust) Pty Ltd., Queensland (AU)

( * ) Notice: Subject to any disclaimer, the term of this patent is extended or adjusted under 35 U.S.C. 154(b) by 1152 days.

(21) Appl. No.: 11/356,520

(22) Filed: Feb. 16, 2006

(65) Prior Publication Data

US 2006/0179721 A1 Aug. 17, 2006

(30) Foreign Application Priority Data

Feb. 17, 2005 (AU) ..... 2005900740
Apr. 8, 2005 (AU) ..... 2005901739

(51) Int. Cl.
*E06B 7/08* (2006.01)

(52) U.S. Cl. ..... 49/74.1; 49/91.1; 49/403

(58) Field of Classification Search ..... 49/74.1, 49/91.1, 92.1, 403
See application file for complete search history.

(56) References Cited

U.S. PATENT DOCUMENTS

| | | | | | |
|---|---|---|---|---|---|
| 2,760,242 | A * | 8/1956 | Armstrong | 49/371 |
| 3,375,608 | A * | 4/1968 | Thompson | 49/403 |
| 3,682,084 | A * | 8/1972 | Tarnoff | 454/359 |
| 4,310,993 | A | 1/1982 | White | |
| 5,297,373 | A * | 3/1994 | Olsen | 52/473 |
| 5,347,756 | A * | 9/1994 | Abbott et al. | 49/74.1 |
| 5,560,147 | A * | 10/1996 | Ashida et al. | 49/74.1 |
| 5,794,380 | A * | 8/1998 | Guardia | 49/74.1 |
| 6,098,340 | A * | 8/2000 | Francis | 49/74.1 |
| 7,104,010 | B2 * | 9/2006 | Winner | 49/403 |
| 2005/0204633 | A1 * | 9/2005 | Winner | 49/403 |

FOREIGN PATENT DOCUMENTS

| | | | |
|---|---|---|---|
| EP | 0 785 335 | B1 | 7/1997 |
| GB | 2 289 327 | A | 11/1995 |
| JP | 2003-049589 | A | 2/2003 |
| JP | 2005-232872 | A | 9/2005 |
| WO | WO 03/046325 | A1 | 6/2003 |

* cited by examiner

*Primary Examiner* — Katherine w Mithchell
*Assistant Examiner* — Catherine A Kelly
(74) *Attorney, Agent, or Firm* — Tarolli, Sundheim, Covell & Tummino LLP

(57) ABSTRACT

The invention is directed to a clip and frame assembly for a louvre window, including a frame with a frame channel and a clip rotatably coupled to the frame, the clip having at least one channel on its back surface adapted to direct water along a flow path to an aperture in the frame channel. The invention extends to a pairing of adjacent clips wherein one or more channels in an upper clip direct water into a channel in a lower clip which is, in turn, directed into the frame channel. Preferably, the clip includes four channels on the back surface with each channel in fluid communication with at least one other channel either in the same clip or in an adjacent clip. The invention extends to a channel being formed in a recess adapted to receive an edge of a louvre plate wherein water in this channel is also directed into the frame channel through an aligned aperture. Further embodiments of the invention may include one or more channels which discharge water outwardly of the clip. The invention extends to a frame and louvre arrangement and a louvre window assembly. The invention further extends to a method of directing water flow in a clip and frame assembly. The assembly may include an operating handle with biasing means to increase contact between adjacent plates.

36 Claims, 14 Drawing Sheets

CLIP AND FRAME ASSEMBLY AND COMPONENTS THEREOF

RELATED APPLICATIONS

This application claims priority from Australian Provisional Patent Application Nos. 2005900740, filed Feb. 17, 2005 and 2005901739, filed Apr. 8, 2005, the subject matter of which is incorporated herein by reference.

FIELD OF THE INVENTION

THIS INVENTION relates to a clip and frame assembly, preferably a clip and frame assembly for use with a window louvre system. The invention extends to a louvre system including the clip and frame assembly and a method of directing liquid flow in a clip and frame assembly.

BACKGROUND OF THE INVENTION

A louvre window commonly comprises a louvre system with a mounting frame, clips and plates, or window panes, adapted for opening and closing overlapping rows of plates. The plates may be made of glass, wood, plastic, metal or other suitable material depending on the desired configuration. For example, translucent glass allows passage of light and transparent glass allows viewing through the plates. Metal plates may provide security when closed.

The plates are each attached to paired clips that are rotatable relative to a vertical mounting frame. The mounting frame supports the clips in an opening in a structure such as a building. One problem with louvre windows is leakage of water from outside to inside of the window during rain. Leakage of water is a particular problem during combined windy and rainy conditions. The location of a leak may be between junction points of each of the above three elements, namely, between the plate and clip and between the clip and mounting frame.

International patent application PCT/AU02/01588 (Breezway Australia Pty Ltd) describes a louvre system comprising a plurality of clips to which plates are attached, wherein each clip comprises a drainage channel for draining water collected between clips. When the clips are in a closed position, the drainage channels of adjacent clips align forming a single drainage channel. Water collected in the drainage channel is drained into a lower part of the louvre frame via the single drainage channel. One potential disadvantage of this system arises because as the number of clips increases, there is a corresponding increase in water volume and pressure within the single drainage channel towards a bottom part thereof. This may result in overflowing or pressurization of the channel and leakage of water into an interior side of a window.

There is a need for a louvre system that is capable of reducing, and preferably preventing, leakage of water from the outside to the inside of a louvre window.

SUMMARY OF THE INVENTION

In a first aspect, the invention resides in a clip and frame assembly for a louvre window, the clip and frame assembly comprising a frame including a frame channel adapted to direct water longitudinally within the frame and at least one first aperture into the frame channel; and a primary clip rotatably coupled to the frame, the primary clip including a first channel located on its back surface and adapted to channel water longitudinally wherein the first channel, the first aperture and the frame channel define a flow path for water to flow from the first channel into and along the frame channel, when aligned in use.

The first channel may further include an opening in an upper longitudinal end thereof.

Preferably the primary clip further includes a second channel, the second channel including an opening at a lower longitudinal end thereof remote from an opening of the first channel.

The clip and frame may further comprise a secondary clip rotationally coupled to the frame and located adjacent to the primary clip, both clips adapted for longitudinal alignment with each other end of the frame.

The secondary clip may include a first channel on its back surface including an opening at an upper longitudinal end thereof.

In a second aspect, the invention provides a louvre system comprising:

(1) a pair of primary clips each including a first channel located on a back surface thereof and adapted to direct liquid longitudinally of each primary clip; and (2) a pair of frames each adapted for coupling to respective primary clips, adjacent to the back surface of each primary clip, wherein each frame comprises:

(a) a frame channel adapted to longitudinally direct a liquid within the frame; and (b) a first aperture in each frame channel that is in fluid communication with the first channel of each primary clip; and (3) a plate attached at opposite ends to a front surface of a respective clip;

wherein the liquid when located within the first channel of each primary clip is directed longitudinally of each clip and capable of entering a respective frame channel via a respective first aperture.

Preferably, the primary clip is rotationally coupled to the frame.

Preferably, the first channel includes an opening at least one longitudinal end thereof.

Preferably, the primary clip further includes a second channel including an opening at a longitudinal end of the clip opposite and below the opening of the first channel.

Preferably, the clip and frame assembly and/or louvre system further includes a secondary clip located adjacent to the primary clip with both clips adapted for longitudinal alignment.

In one preferred form, the second clip includes a first channel on a back surface thereof including an opening at a longitudinal end in fluid communication with the respective opening of the second channel of the primary clip when the clips are substantially vertically aligned.

Preferably, the second channel of each primary clip and the first channel of each secondary clip are in liquid communication with each other when the primary and secondary clips are longitudinally aligned.

In another preferred form, the opening of the second channel of the primary clip is adapted to direct fluid away from the second channel and external of the clip.

Alternatively, the second channel of the primary clip and first channel of the secondary clip may not communicate.

Preferably, the frame includes an aperture adapted for fluid communication with a corresponding first channel of the secondary clip when the secondary clip is substantially vertical.

Preferably, the back surface of each primary and secondary clip includes a third channel located adjacent the first channel, wherein the third channel is adapted for fluid communication with the first channel of the corresponding clip.

Preferably, a gap is located between the frame and a wall separating the first and third channels to provide fluid communication between the first and third channels.

Preferably, the gap is of suitable size to allow formation of water surface tension between the frame and the wall when liquid is located therein.

Preferably, each primary and secondary clip further include a fourth channel located adjacent the first channel opposite and spaced from the third channel.

Preferably, a gap is located between the frame and a wall separating the first and fourth channels to provide fluid communication between the first and fourth channels.

Preferably, the gap is of suitable size to allow formation of water surface tension between the frame and wall when liquid is located therein.

Preferably, the fourth channel of the primary clip and the first channel of the secondary clip are in fluid communication with each other when the primary and secondary clips are longitudinally aligned.

Preferably, the front surface of each clip comprises a recess adapted to receive the plate.

Preferably, the plate is spaced from a bottom surface of the recess thereby defining a fifth channel adapted to direct water longitudinally thereof.

Preferably, the recess of the clip includes a drainage aperture located on the bottom surface thereof adapted for alignment with a second aperture in the frame in fluid communication with the frame channel.

Preferably, the drainage aperture of each clip and each second aperture of the frame are in fluid communication with corresponding channels when the clips are aligned longitudinally with the frame.

Preferably, the recess includes a seal located on the bottom surface thereof and adjacent to the drainage aperture adapted for directing water into the drainage aperture.

In a preferred form, the clip further comprises a second drainage aperture located within a bottom surface of the recess providing fluid communication with the second channel.

Preferably, a seal is located on the bottom surface of the recess and adjacent to the second drainage aperture and adapted for directing water into the second drainage aperture.

In one preferred form, the recess of the clip includes an opening at a longitudinal end thereof.

Preferably, the recess of the clip includes an opening at each longitudinal end thereof.

Preferably, the recess of the primary clip and the recess of the secondary clip are in fluid communication when the clips are aligned.

In another preferred form, the recess of the primary clip and the recess of the second clip are not in fluid communication at any orientation.

Preferably, the clip and frame assembly and/or louvre system comprises two or more clips.

More preferably, the clip and frame assembly and/or louvre system comprises three or more clips, wherein each adjacent clip is adapted for fluid communication with an adjacent clip.

In one preferred form, each adjacent clip is in fluid communication therebetween via the second channel of one clip and a first channel of an adjacent lower clip.

Preferably, each adjacent clip is further adapted for fluid communication via the fourth channel of one clip and the first channel of an adjacent lower clip.

Preferably, each adjacent clip is adapted for fluid communication via respective fifth channels.

In another alternative form, each fifth channel clip is not in fluid communication with a fifth channel of an adjacent clip.

Each clip may include an exit aperture for directing a liquid externally of a fifth channel of the clip and of the clip itself.

The exit aperture may be in fluid communication with the third channel.

In a third aspect, the invention provides a clip for use with a clip and frame assembly and/or louvre system, the clip comprising:

(i) a first channel located on a back surface thereof and adapted for directing a fluid longitudinally of the clip when others turn horizontal;

(ii) a recess located on a front surface of the clip, opposite the back surface and adapted to receive a plate; and (iii) a drainage aperture located within a bottom surface of the recess adapted to channel a liquid therethrough.

Preferably, the first channel includes an opening at an end thereof.

The clip may further include a second channel including an opening at a longitudinal end thereof opposite the opening of the first channel.

The opening of the first channel of the clip may be adapted for mating with the second channel of another upper clip to provide fluid communication therebetween when the clips are longitudinally aligned.

The back surface of the clip may comprise a third channel located adjacent the first and second channels wherein the third channel is adapted for fluid communication with the first channel.

Preferably, each clip further includes a fourth channel located adjacent the first channel and second channel, opposite and spaced from the third channel.

Preferably, the plate when located within the recess is spaced from the bottom surface of the recess thereby defining a fifth channel adapted to direct a fluid longitudinally thereof.

In a preferred form, an opening of the recess of the clip mates with an opening of a recess of another clip so that both recesses are in fluid communication when the clips are vertically aligned.

Preferably, the drainage aperture is adapted for alignment with a frame aperture located on the frame.

Preferably, the drainage aperture and frame aperture are aligned when the clip is longitudinally aligned with the frame.

Preferably, the recess comprises a seal located on the bottom surface and adjacent to the drainage aperture, the seal adapted for directing a liquid into the drainage aperture.

In another preferred form, the clip includes a drainage aperture located within a bottom surface of the recess and in fluid communication with the second channel.

Preferably, the clip includes an exit aperture capable of directing a liquid exterior of at least one channel of the clip.

Preferably, the exit aperture is in fluid communication with the second channel.

Preferably, the clip includes a collection channel in fluid communication with the second channel.

In a fourth aspect, the invention provides a frame for use with a louvre system comprising:

(I) a body;

(II) a rotational member rotatably coupled to the body and adapted for coupling to a louvre clip;

(III) a first arm attached to the rotational member;

(IV) a second arm attached to the rotational member at a location separate from the first arm;

(V) a third arm coupled at one end to the first arm;

(VI) a handle coupled at one end to the third arm and coupled at a location intermediate the ends to the second arm;

(VII) a bias member coupled at one end to the third arm and handle and coupled at an opposite end to the first arm;

wherein, in an opened position the third arm and bias member are substantially parallel to the first arm and in a closed position the third arm is rotated in a direction towards the second arm around a point where the first arm is coupled to the third arm thereby extending the bias member.

Preferably, the second arm is coupled to the rotational member at a location separate from the first arm.

Preferably, the frame includes a plurality of rotational members.

Preferably, the first arm and second arm are coupled to the rotational member such that rotation of the rotational member moves the first arm and second arm longitudinally in opposite directions.

Preferably, the handle is coupled to the third arm at an end of the third arm opposite attachment to the first arm.

Preferably, the bias member is coupled to the third arm and handle at a junction therebetween.

Preferably, rotation of the rotational member is actuated by movement of the handle.

Preferably, when the handle is in the closed position and the bias member is extended, a retracting force pulls the handle towards the first arm thereby retaining the frame in the closed position.

Preferably, when the frame is in the opened position, the bias member is relaxed.

Preferably, the frame further comprises a louvre clip attached respectively to the or each rotational member.

Preferably, when the frame is in the closed position, the louvre clip(s) are longitudinally aligned with the frame.

In a preferred form of the invention, a plurality of clips are attached to a plurality of respective rotational members.

Preferably, a plate is coupled to the or each clip.

Preferably, the plate is coupled at opposite ends to corresponding clips.

Preferably, when the frame is positioned in the closed position each plate overlaps with an adjacent plate.

It will be appreciated that in a preferred form of the invention, the clip comprises at least one channel on a back surface thereof capable of fluid communication with the frame channel via an aperture in the frame. In another preferred form of the invention, the clip comprises at least one channel formed within a recess that is adapted to receive a plate, wherein the channel is capable of fluid communication with the frame channel via an aperture in the recess that is capable of aligning with an aperture in the frame. Preferably, the clip comprises at least one channel located on a back surface and one channel on a front surface, wherein each channel is capable of fluid communication with the frame channel via respective apertures in the frame. The above features direct water from between the clip and the frame and from between the clip and the plate into the frame channel at locations adjacent each clip along the length of the louvre. This creates a similar, low water pressure on a backside of the clips along an entire length of the louvre, thereby reducing, preferably preventing, leaking of water from one side of the louvre to the other. This overcomes the problem of previous louvres that leak water from one side of the louvre to the other because of an increase in water pressure along the length of the louvre when the louvre is closed and in a vertical orientation.

In yet a further aspect, the method may comprise a method of draining water from one or more louvre clips, the method comprising the steps of:

channelling water along a channel located on a back surface of each of the louvre clips; directing the water through a first aperture and into a channel in a frame supporting the louvre clip.

The method may further include the step of directing water from one or more other channels into the first channel.

The method may further include the step of channelling water from an adjacent upper louvre clip into the first channel.

The method may further include the step of directing water from one or more channels externally to an outer surface of the clip.

The method may further include the step of channelling water from a channel formed by a recess adapted to receive a plate and a plate edge, the water channelled through a second aperture and into the frame channel.

Throughout this specification unless the context requires otherwise, the word "comprise", and variations such as "comprises" or "comprising", will be understood to imply the inclusion of the stated integers or group of integers or steps but not the exclusion of any other integer or group of integers.

BRIEF DESCRIPTION OF THE DRAWINGS

In order that the invention may be readily understood and put into practical effect, preferred embodiments will now be described by way of example with reference to the accompanying drawings wherein like reference numerals refer to like parts and wherein.

DETAILED DESCRIPTION OF THE INVENTION

Figure 1:
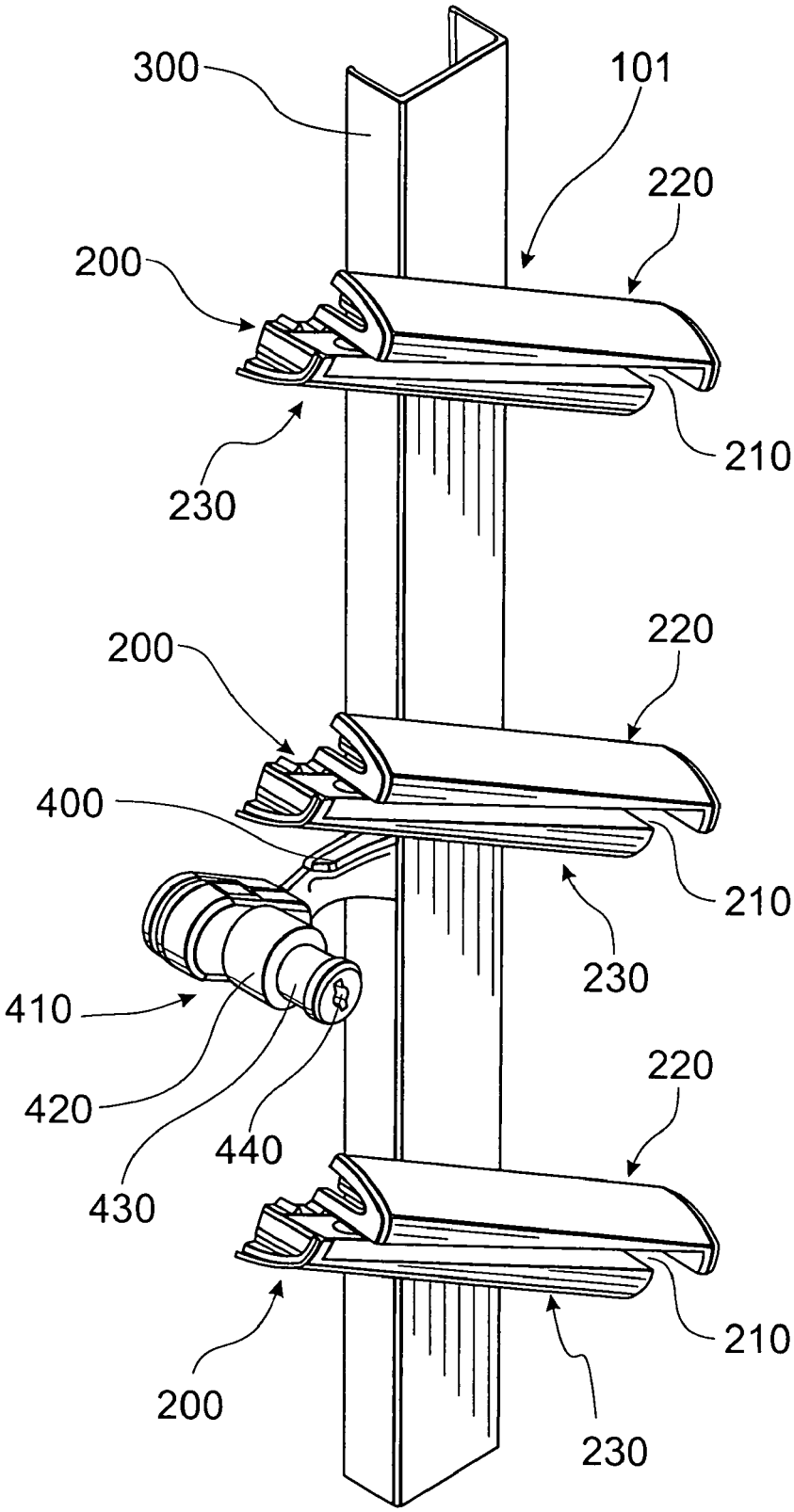
FIG. 1 is an isometric view of a clip and frame assembly in an open configuration.
Figure 2:
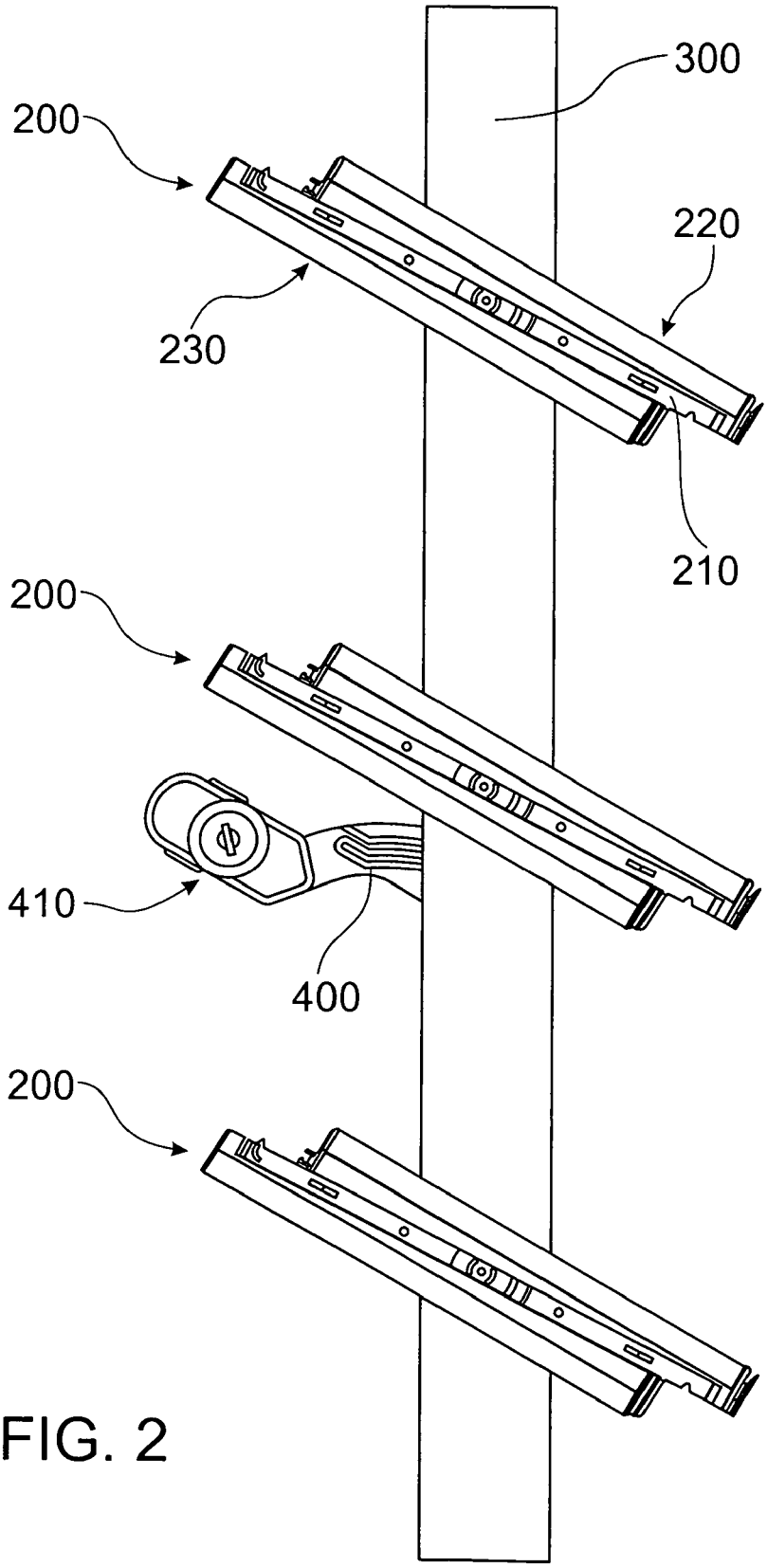
FIG. 2 is a side view of the clip and frame assembly shown FIG. 1.
Figure 3:
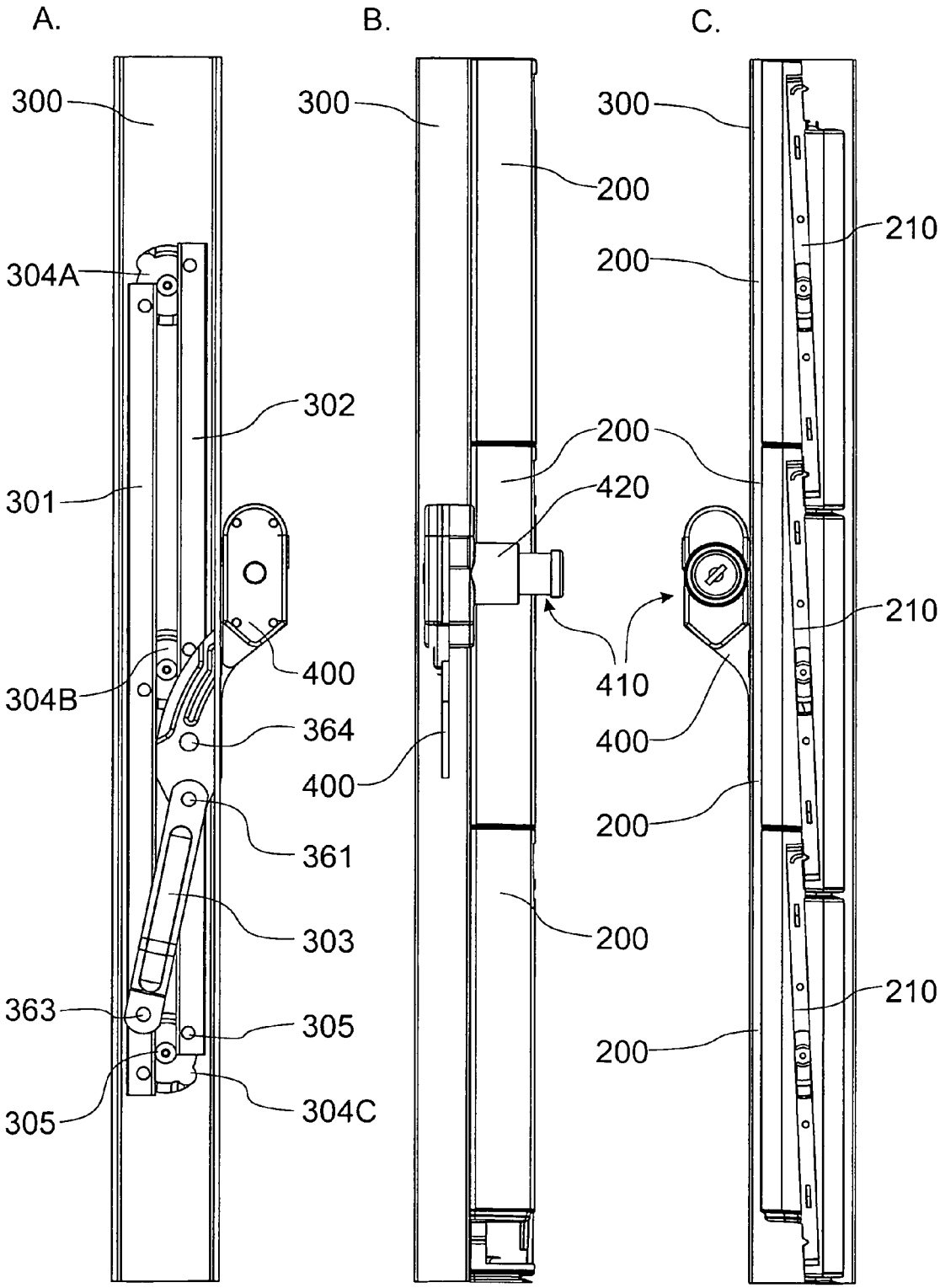
FIG. 3A is a back view of a louvre frame.
FIG. 3B is a side view of the louvre frame shown in FIG. 3A.
FIG. 3C is a front view of the louvre frame shown in FIG. 3A.

In a preferred embodiment of the invention, a controlling portion 101 comprising a clip and frame assembly of a louvre system 100 is shown in FIGS. 1 and 2 comprising three clips 200, each attached to a frame 300. The controlling portion 101 comprises a handle and actuating arms for controlling movement of the clips 200 and plates 500 between opened and closed positions as described hereinafter. It will be appreciated that the louvre system 100 also comprises a second frame and clips attached thereto (not shown) coupled to the plates 500 at an end opposite that of the clips 200 and frame 300 of the controlling portion 101. However, the clips have a configuration that is a mirror image of the clips 200 shown herein for the controlling portion 101 and are passively moved by operation of the controlling portion. Also, the second frame and clips attached thereto of the invention include the same fluid directing channels, apertures and other features as described herein for the controlling portion 101 of the louvre system 100. The second frame may omit first, second and third arms 301, 302, 303 and handle 400 described in FIG. 3 for actuating movement of the clips, and accordingly may only comprise the frame 300, with frame channel 310, and rotational members 304.

Figure 6:
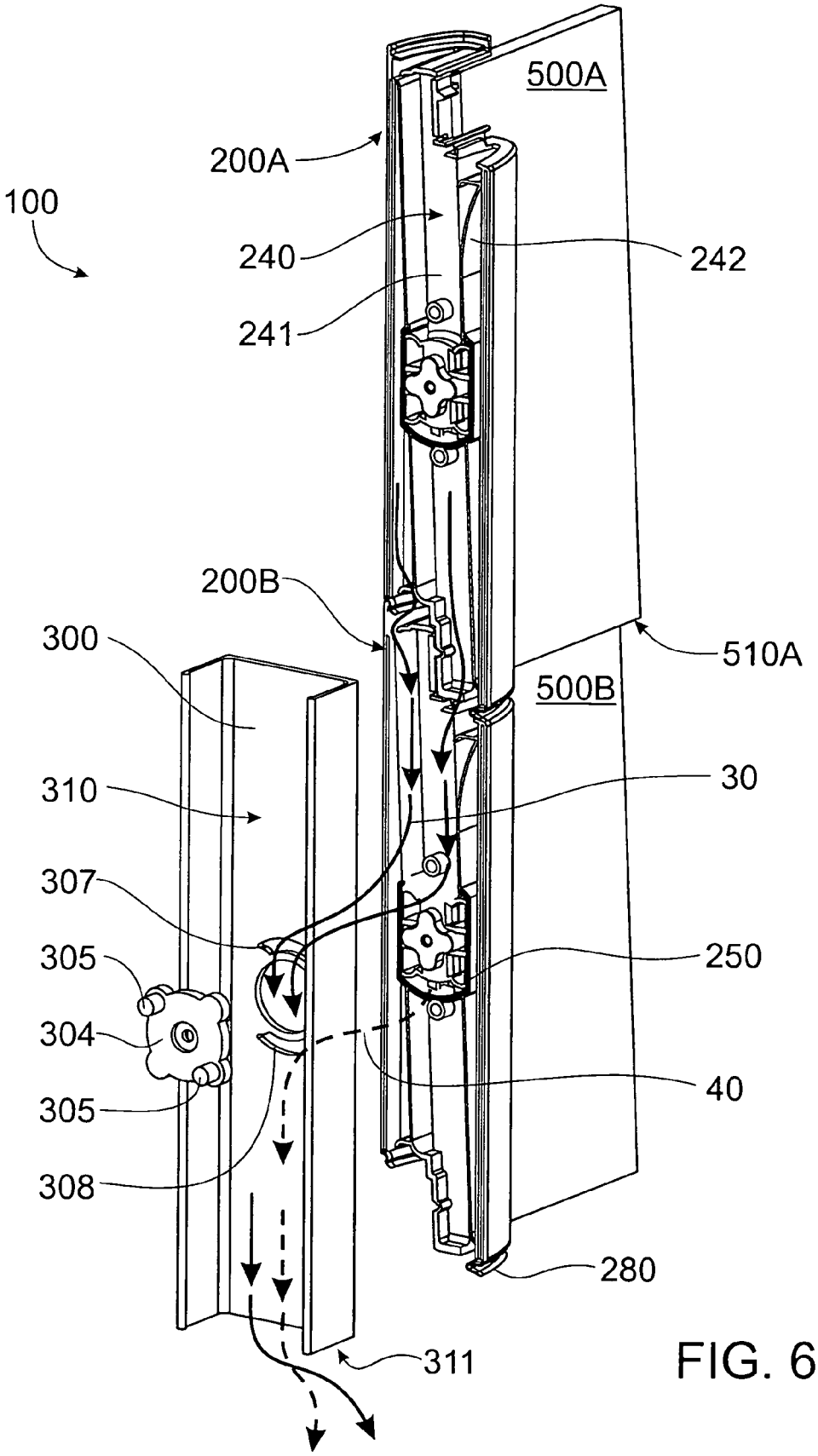
FIG. 6 is a partial exploded isometric view of two louvre clips, frame and plates.

Each clip 200 comprises an outer surface 220 an inner surface 230 and a recess 210 located therebetween. When the louvre system 100 is installed in a structure, for example a house, the outer surface 220 is oriented towards an exterior of the structure and inner surface 230 is oriented towards an interior of the structure when wholly or partially closed. A plate 500, shown in FIG. 6, is insertable into recess 210. The plate 500 may be formed from glass, plastic, wood, metal or any other suitable material.

Each clip 200 is rotatable relative to the frame 300. A handle 400 is used for actuating rotation of the clips 200 from an opened position shown in FIGS. 1 and 2 to a closed position, as shown in FIGS. 3A-3C and 6 and in reverse operation. A preferred mechanism for actuation is described hereinafter in relation to FIGS. 3A-3C, 9 and 10. In the opened position, each clip 200 is not longitudinally aligned with the frame 300, as shown in FIGS. 3A-3C, but instead is oriented at a variable angle preferably above horizontal as shown in FIGS. 1 and 2. In the closed position shown in FIG. 6, each clip 200 is longitudinally aligned, shown vertically aligned, so that adjacent clips 200 interconnect and adjacent plates 500A and 500B, attached to respective clips 200, overlap. A lower edge 510A of plate 500A overlaps with an upper edge of plate 500B thereby forming a barrier from water entering between the plates 500A, 500B, as will be discussed in further detail hereinafter.

The handle 400 is shown with an optional lock 410 that comprises a lock body 420 and a member 430 that is insertable through the lock body 420 and into a mating aperture located on either an adjacent wall or frame, (not shown). The lock 410 is locked and unlocked by inserting a key into keyhole 440. Preferably, the lock 410 secures the louvre system 100 in a closed position.

FIGS. 3A-3C show respective back, side and front views of the frame 300 with clips 200 coupled thereto in a closed position. The clips 200 are coupled to rotational members 304A-304C by mating with member 251 so that rotation of each rotational member 304A-304C results in rotation of coupled clip 200. In this manner, controlling rotation of each clip 200 is possible via actuating rotational members 304A-304C. Each rotational member 304A-304C is operatively linked to both first arm 301 and second arm 302 by pegs 305. The first arm 301 is attached at one side of the rotational member 304A-304C and the second arm 302 is attached to an opposite side of the rotational member 304A-304C across from a rotational point of the rotational member 304A-304C as shown. The first arm 301 and second arm 302 are shown substantially parallel to each other. This arrangement allows for rotation of each rotational member 304A-304C by movement of the first arm 301 and second arm 302 in opposite directions. Also, rotation of each clip 200 is simultaneously actuated by linking movement of first arm 301 and second arm 302.

Figure 9:
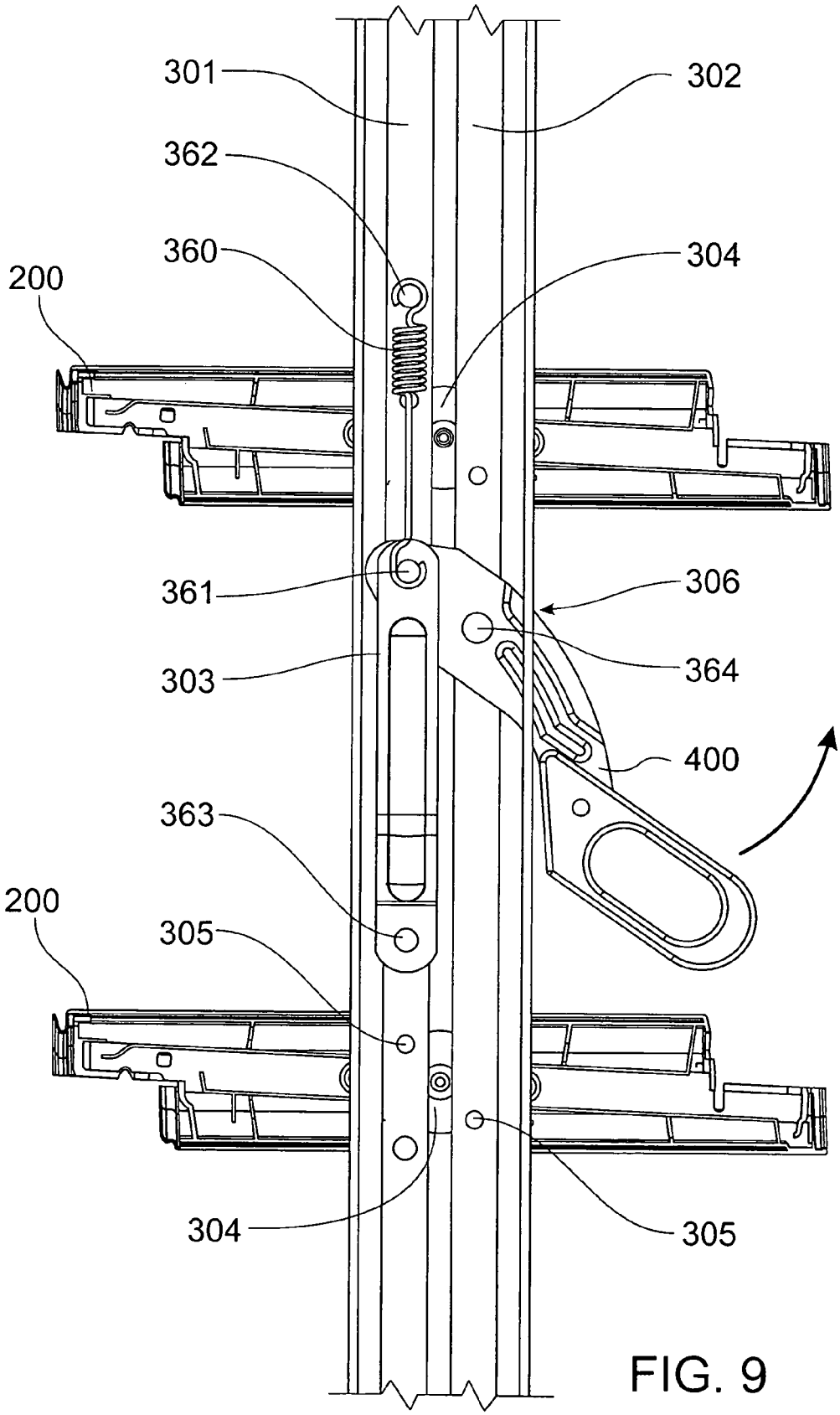
FIG. 9 shows a back surface of a preferred embodiment of a frame and clip assembly in an open position and including a tension spring.
Figure 10:
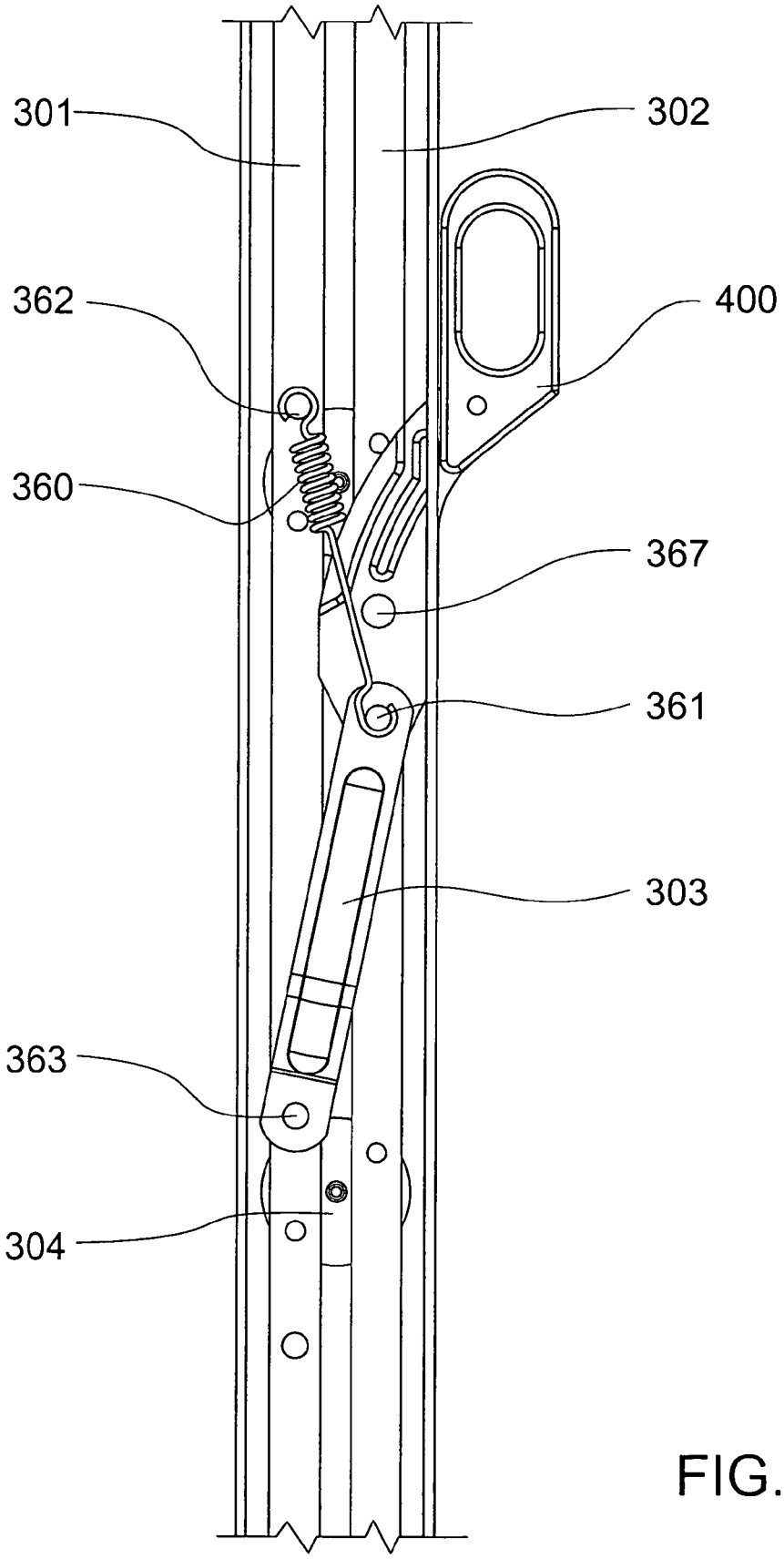
FIG. 10 shows arrangement of FIG. 9 in a closed position.

Movement of the first arm 301 and second arm 302 is actuated by moving handle 400. This movement is more clearly seen in FIGS. 9 and 10 in a preferred embodiment of the invention. The handle 400 is coupled to both the first arm 301 and second arm 302 to allow for actuation of both arms 301, 302 simultaneously. The handle 400 is directly coupled to the second arm 302 at location 364, which is intermediate the ends of the handle 400. The handle 400 is indirectly coupled to the first arm 301 via a third arm 303. The third arm 303 is attached at one end to the first arm 301 at location 363 and at an opposite end to an end of the handle 400 at location 361 as shown. The third arm 303 is rotatable about location 363 as shown in FIGS. 9 and 10 so that the third arm 303 can rotate form being aligned with the first arm 301 in an opened position (FIG. 9) to the closed position (FIG. 10) shown in FIGS. 3A-3C.

As shown in FIGS. 4A-4C and FIG. 5, the clip 200 includes four channels 241, 242, 243, 234 located on a back surface 240. First channel 241 is located centrally and at a top of the clip 200 in the orientation shown in FIG. 4A. Second channel 234 is located below first channel 241 and between third channel 242 and fourth channel 234. Third channel 242 lies alongside first channel 241 and second channel 234 and is positioned towards the outer surface 220. Fourth channel 243 is located adjacent to first channel 241 and second channel 234 on a side oriented towards an inner surface 230 of the clip 200. Water is collected within each channel 241, 242, 243, 234 and is directed downward via gravity when the clip 200 is vertical as shown or at other angles above horizontal. When the clip 200 is located adjacent to a frame 300 water collected within the first channel 241 exits along a flow path from the back surface 240 of the clip 200 through the top drainage aperture 307 located on a frame 300, as shown in FIG. 6. A fifth channel 244 is located within recess 210 and is discussed hereinafter. Also shown in FIG. 4A are apertures 252 that are optionally used to secure the clip 200 at a fixed angle relative to the frame 300 by passing a fastener, such as a screw, bolt or rivet, through the aperture and securing the fastener to the frame 300 for permanent/secure fixation at a selected angle.

Figure 5:
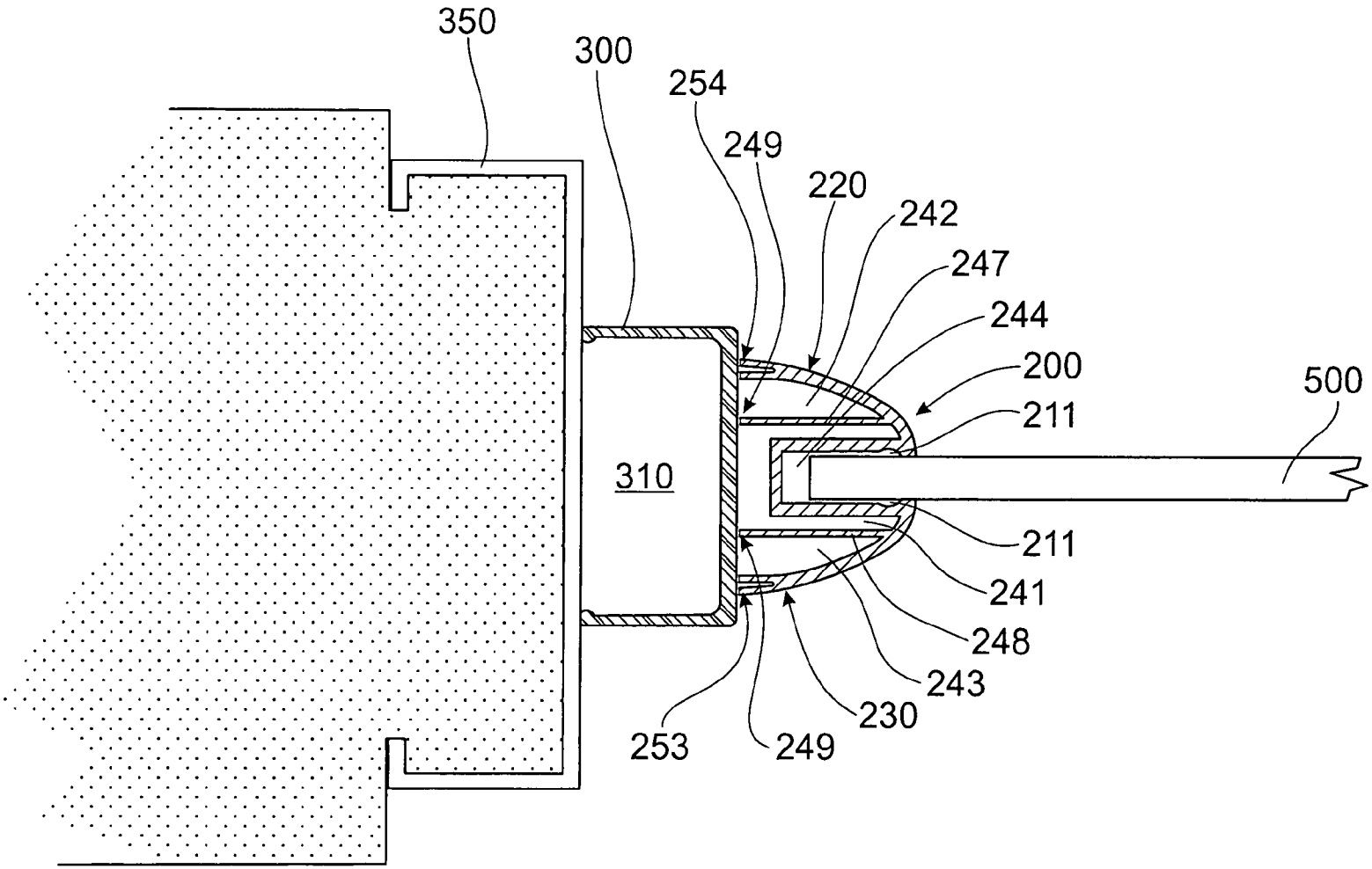
FIG. 5 is a cross section of a plan view of a louvre system.

FIG. 5 shows a plan cross section of a clip 200 illustrating location of first channel 241, third channel 242, fourth channel 243 and fifth channel 244. The second channel 234 is located below the first channel 241 and is not seen in this view. Wall 247 separates the first channel 241 and third channel 242 and wall 248 separates the first channel 241 and fourth channel 243. A gap 249 is provided between each wall 247 and 248 and the frame 300. The gap 249 provides a seal between the respective walls 247 and 248 with the frame 300 based on a principle of "molecular cohesion of water" wherein water trapped within the gap 249 provides a seal. Preferably, the gap 249 is about 0.1 mm. As there is minimal physical contact with the frame 300, there is no additional friction between the clip 200 and frame 300 when the clip 200 rotates between open and closed configurations. A similar arrangement and walls are provided for the second channel 234 with respect to adjacent channel 242 and 243

The outer surface 220 and inner surface 230 of the clip 200 are split at respective ends 253, 254 that contact frame 300; thereby providing an effective double seal contact to the frame 300, in a manner similar to a wiper seal. It is preferred that friction between the clip 200 and frame 300 is minimal when the clip 200 is rotated relative to the frame 300, for example when opening and closing the clips 200 as part of a louvre system.

The plate 500 is shown inserted into recess 210. A pair of grooves 211 are located as shown in opposite side walls of the recess 210. The grooves 211 may assist with trapping and collecting water from between the plate 500 and recess 210.

Figure 7:
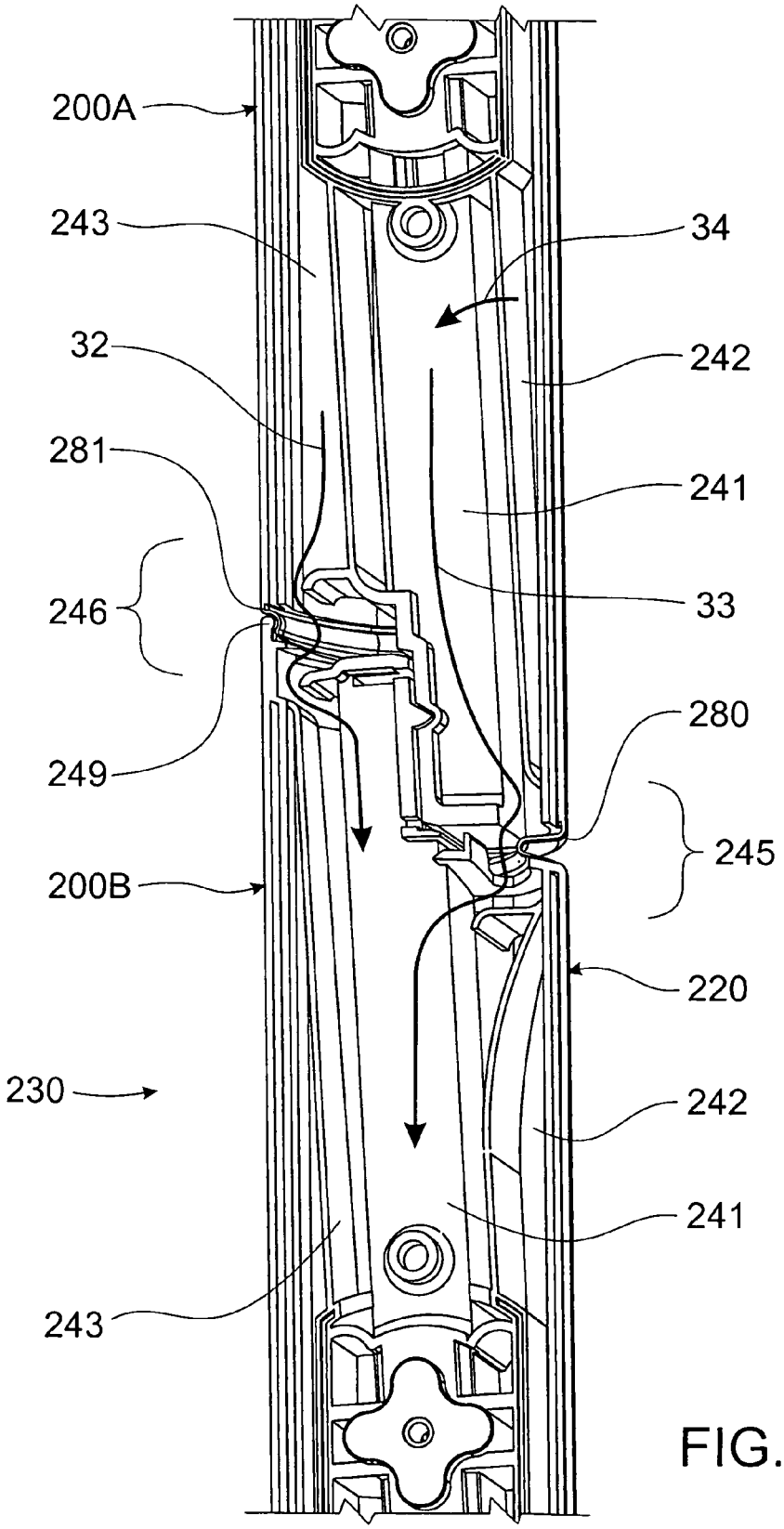
FIG. 7 shows a back surface of two adjacent clips, with a preferred water flow path indicated.

FIG. 6 illustrates flow paths of directed water flow between two adjacent clips 200A and 200B. Only a bottom portion of frame 300 is shown, and it will be appreciated that frame 300 extends longitudinally adjacent to both clips 200 shown with drainage into the frame from each clip and indeed from all clips attached to the frame. It is preferred that the drainage apertures 307, 308 are located adjacent to each clip 200 of the louvre system 100. Water flows along a flow path from between the clip 200 and frame 300, shown with solid arrows 30, and water flows along a flow path from between the plate 500A, 500B and each clip 200A, 200B within recess 210 as shown with dashed arrows 40. It is preferred that water flows from second channel 234 of primary clip 200A into first channel 241 of secondary clip 200B through opening 247 in an upper longitudinal end of the first channel. The second channel has opening 248 in lower longitudinal end to communicate with the opening in a lower adjacent clip in the first channel. Water directed from between the clip 200 and frame 300 flows along a flow path along the back surface 240 of clip 200 and exits from the first channel 241 through top drainage aperture 307 into frame channel 310 of frame 300. FIG. 7 shows close up detail of two adjacent clips 200 in a closed configuration wherein each clip 200A, 200B is longitudinally aligned with each other. When the louvre system 100 is closed, channels align as described hereinafter to allow water to flow from an upper primary clip 200A to a lower secondary clip 200B. As shown by arrows 32, 33, water flows along a flow path (arrow 33) from the second channel 234 of the upper primary clip 200A into the first channel 241 of the lower secondary clip 200B via a front second-first channel connecting channel 245. The primary and secondary clips may be identical with a secondary clip forming a primary clip in relation to a further clip below it. Water flows from the fourth channel 243 of the upper clip 200A to the first channel 241 along a flow path (arrow 32) of the lower clip 200B via rear fourth-first connecting channel 246. Water flows from the third channel 242 of the upper clip 200A to the first channel 241 of the second channel 234 of the upper clip 200A via capillary action and the gap 249 and is shown by arrow 34. Water collected in the first channel 241 enters into the frame channel 310 of the frame 300 via top drainage aperture 307.

It will be appreciated that a louvre system of the present invention allows for water collected in the clips 200 to exit therefrom into the frame channel 310. The respective drainage apertures 307 direct water away from an adjacent respective clip 200 to thereby prevent continued water accumulation within the clips 200 when the louvre system 100 is vertically oriented as shown in FIG. 1 and the channel drainage aperture and frame channel are aligned. Water flows between adjacent clips 200 exits into the frame channel 310 with a maximum level of two adjacent clips 200. If all of the clips of a typical louvre system were aligned, the water pressure and volume within clips at a lower end of the louvre increases and may result in water flowing towards an inner side of the louvre to the inside of a structure, such as a building. Such leakage may result in costly damage.

Figure 4:
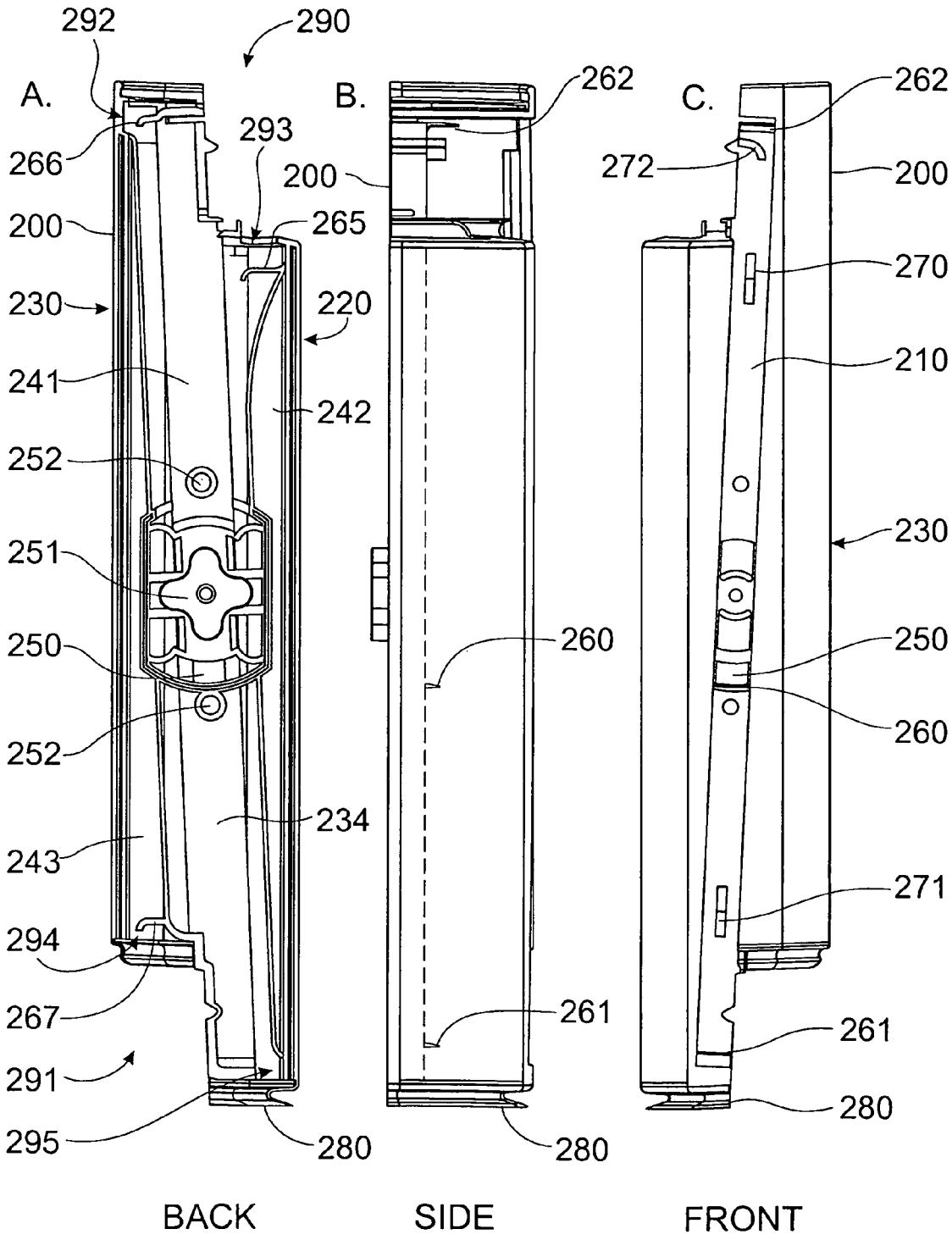
FIG. 4A is a back view of a louvre clip.
FIG. 4B is a side view of the louvre clip shown in FIG. 4A.
FIG. 4C is a front view of the louvre clip shown in FIGS. 4A and 4B.

As shown in FIG. 5, water directed from between plate 500 and clip 200 flows within the fifth channel 244, which is formed within recess 210 and adjacent to plate 500. As shown in FIG. 4, stops 270, 271, 272 are located within the recess 210 to prevent the plate 500 from contacting a bottom surface of the recess to thereby define the depth of the fifth channel 244. The stop 272 also functions to prevent possible damage to seal 262, a similar stop (not shown) may be located at an opposite end of the recess 210 to likewise protect seal 261. Also, the stop 272 may dampen or reduce rising fluid within the fifth channel 244 in the event of large volumes of water flow. A location of potential water leakage between the plate 500 and clip 200 is at a junction therebetween adjacent to seal 261 and 262. Accordingly, the stop 272 assists with reducing a potential for leaking of a fluid at this location. When the plate 500 is inserted into the respective recess 210 of two clips 200 located on opposite ends of plate 500, both ends of the plate 500 are sealed at six points by seals 260, 261, 262 of each clip 200. The seals 260, 261, 262 preferably made of a resilient material also function to provide a force against a respective end of the plate 500 and clip 200 thereby forcing ends 253, 254 of the external and internal surfaces 220 and 230 of the clip 200 towards the frame 300. This force improves sealing between the clip 200 and frame 300 and also reduces or eliminates passage of light between the clip 200 and frame 300.

Figure 8:
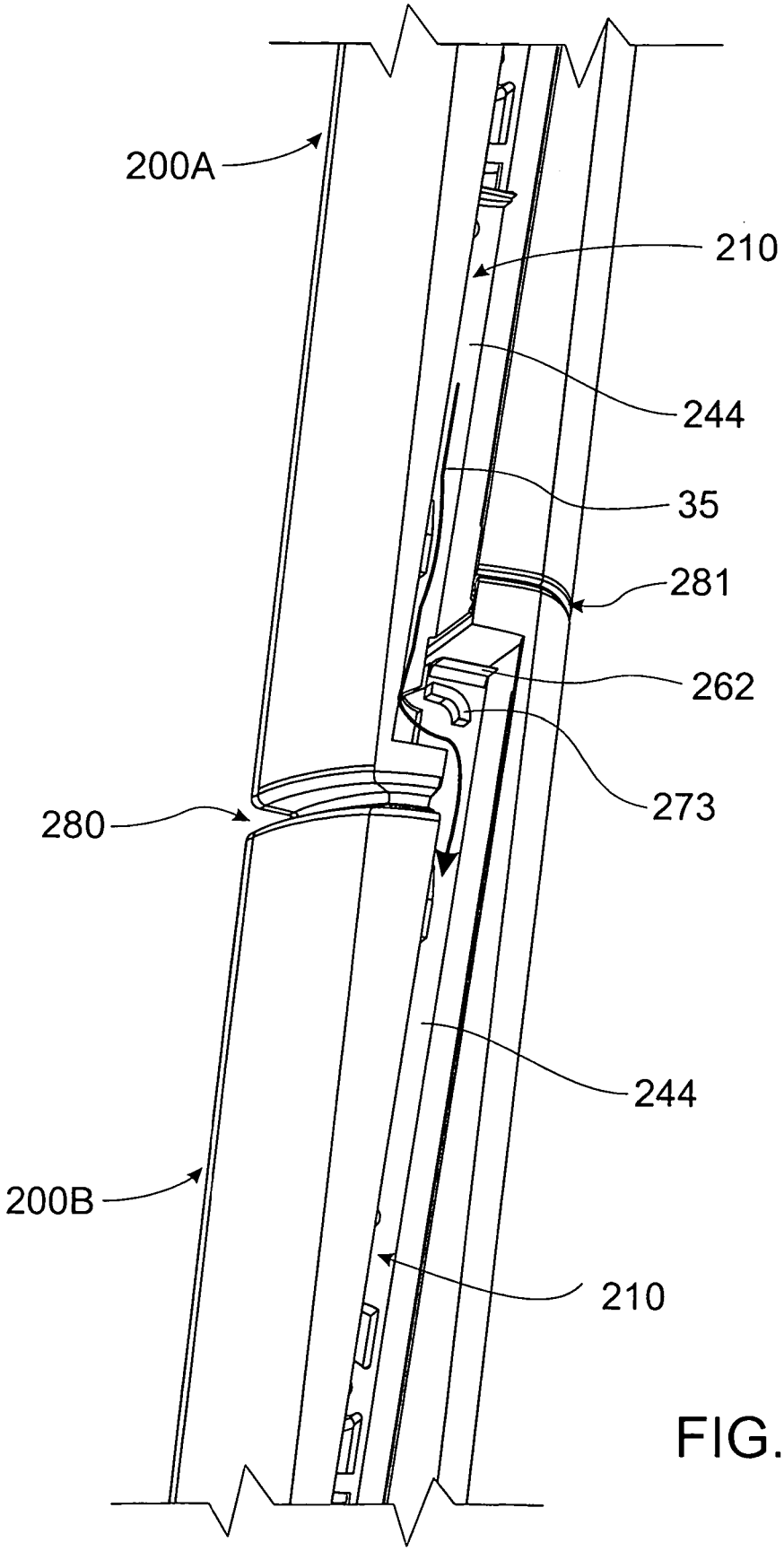
FIG. 8 shows a front surface of two adjacent clips, with a preferred water flow path indicated.

FIG. 8 shows two adjacent clips 200A and 200B longitudinally aligned so that respective fifth channels 244 are in fluid communication, along flow path shown by arrow 35 (plate 500 not shown). Also shown in FIG. 8 is a seal 262 shown as a flange that contacts the plate 500 when the plate 500 is inserted into the recess 210. A seal 261 is located at an opposite end of the recess 210 as shown in FIG. 4. Seals 261, 262 reduce or prevent water from leaking from between the plate 500 and the fifth channel 244. Also shown in FIG. 8 is stop 272 that prevents the plate 500 from sitting flush with a bottom surface of the recess 210 and therefore assists with forming the fifth channel 244.

Water flows within the fifth channel 244 from between clips 200 until the water contacts seal 260, shown in FIGS. 4A-4C, which is located intermediate ends of the recess 210 and adjacent to aperture 250, which extends through the clip 200 as shown in FIGS. 4A-4C. Aperture 250 aligns with bottom drainage aperture 308 of the frame 300 to allow water to pass from the fifth channel 244 into the frame channel 310. This arrangement allows for water to exit from within the fifth channel 244 intermediate the length of the louvre system 100. This prevents an accumulation of water flowing from a top part of the louvre system 100 to a bottom part of the louvre system 100. Frame channel 310 is shown larger in volume than a back surface 240 or recess 210 of the clip 200, and accordingly the frame channel 310 is capable of accommodating a larger volume of water flow therethrough. The water is discharged at a bottom drain 311 of the frame 300 as shown in FIG. 6.

As shown in FIGS. 7 and 8, clip 200 includes an outer seal 280 located at an end of the clip 200, shown as a lower end of the clip 200A when the clips 200A, 200B are vertically within the louvre system 100. The outer seal 280 only slightly contacts or is spaced from the lower clip 200B when the clips 200A, 200B are longitudinally aligned so that there is little or no force created by the outer seal 280 between adjacent clips 200A and 200B. This allows for the plates 500 to form a tighter seal between adjacent plates 500 as a locking force of the handle mechanism transfers optimum force to the plate-to-plate contact without hindrance by contact from adjacent clips 200. If a force is applied against the outer seal 280 in a direction towards the length of the clip 200, the outer seal 280 will be forced against the lower clip 200B thereby sealing a junction between upper clip 200A and lower clip 200B. The greater the force, such as wind pressure, against the outer seal 280, the greater the seal formed with the adjacent clip. The outer seal 280 is preferably useful to prevent water and wind from entering between adjacent clips 200. The outer seal 280 is preferably made of a flexible material, more preferably a resilient material.

An inner seal 281 is shown located on a side opposite the outer seal 280, which functions in a similar manner as the outer seal 280. However, the inner seal 281 is forced against an internal surface of the lower clip 200B in response to an internal force, such as a force created by rain and/or wind, as shown in FIG. 7. Known louvres sometimes include an extension that overlaps with an adjacent clipping hood. A disadvantage of this arrangement is that it is not possible in practice to provide a positive seal between adjacent clips without weakening the plate-to-plate pressure contact. This results in leaking of water and/or air between plates 500. An extension 249 shown in FIG. 7 is spaced from seal 281, preferably spaced about 0.3 mm from the seal 281, when the louvre 100 is in closed position and does not function as a seal without positive pressure, when sealing is required. The extension 249 also is aesthetically pleasing and protects the end of the clip 200 and seal 281 when closed.

FIGS. 9 and 10 show a back side of a frame 300 of a louvre system 100 similar to that shown in FIGS. 3A-3C, however, a coiled spring 360 is attached to an end of the third arm 303 at location 361 and an intermediate location 362 of the first arm 301 as shown. The spring 360 provides a force to retain the louvre system 100 in a closed position, wherein adjacent plates 500 coupled to clips 200 are overlapping as shown in FIG. 10.

The spring 360 is relaxed when the louvre system 100 is in an opened configuration as shown in FIG. 9, wherein the third arm 303 and spring 360 are substantially aligned with the first arm 301. When the handle 400 is moved in a direction shown by an arrow 40 in FIG. 9 towards the frame 300, the louvre system 100 is closed as shown in FIG. 10. The handle 400 is moved within a guide channel 306 located in the frame 300. As the third arm 303 rotates about location 363 in a counter-clockwise direction, location 361 is moved away from location 362 thereby expanding or stretching the spring 360. This action stretches the spring 360 thereby creating a pulling force between point 361 of the third arm 303 and point 362 of the first arm 301, which pulls the first arm 301 and second arm 302 to a closed configuration. A force is also applied to the second arm 302 in an opposite direction to further apply a force to retain the louvre system 100 in a closed configuration. This force is derived when the third arm 303 is moved over the centre resulting in a handle 400 locking force. As the handle 400 locks firmly in place, the stretched spring 360 pulls arm 301 in the direction of the closed configuration. It will be appreciated that the coiled spring 360 shown is a preferred device for creating a force as shown, however, other biasing members may be used, for example a leaf spring, elastic member and the like.

FIGS. 11-14 illustrate another embodiment of a clip 600 that like the previous embodiments is in fluid communication with the frame channel 310 of the frame 300. However, this embodiment is characterised by the clip 600 diverting some water away from an adjacent clip 600 rather than water flowing between adjacent clips. This embodiment also has the advantage of preventing an accumulation of fluid and pressure within an interconnected row of aligned clips.

Figure 11:
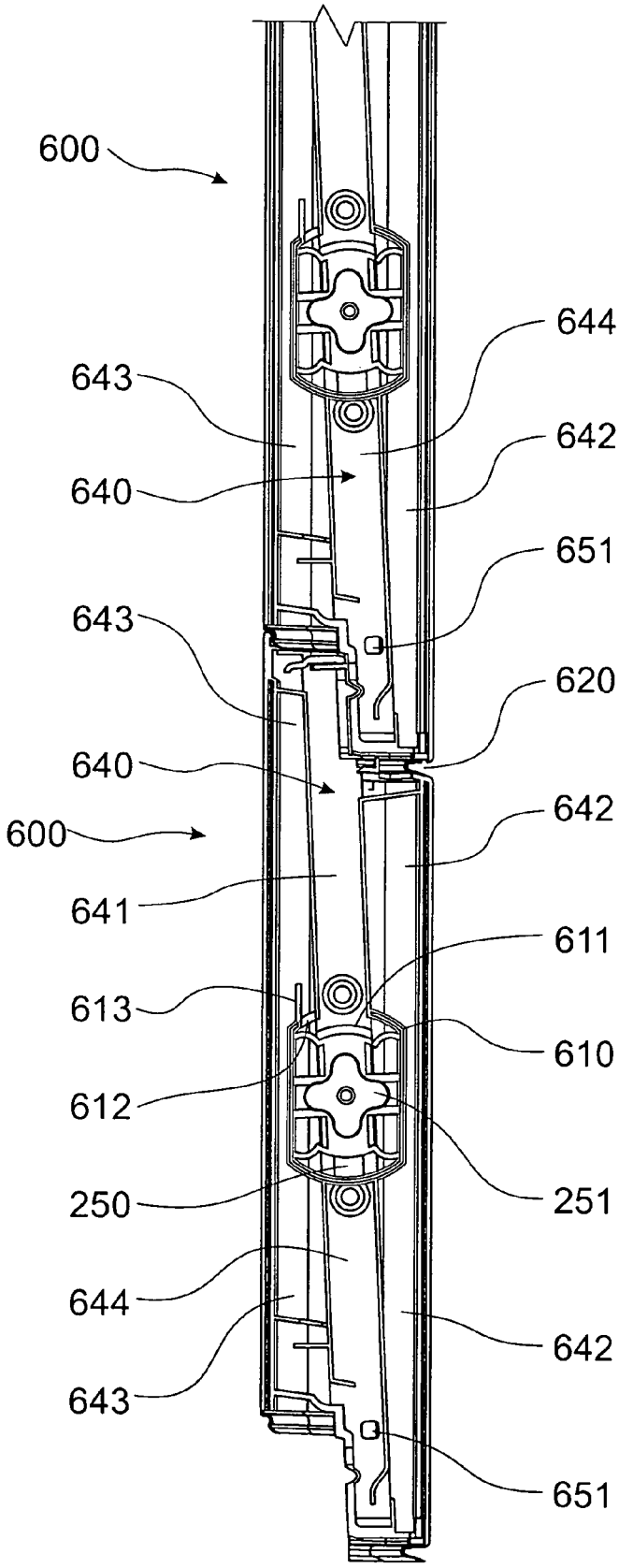
FIG. 11 shown a back surface of a preferred embodiment of two adjacent clips that are not in fluid communication with each other.

As shown in FIG. 11, the clip 600 comprises a first channel 641, second channel 644, third channel 642 and fourth channel 643 each located on a back surface 640. Like the channels shown for the previous embodiments, water is directed to flow longitudinally of each channel when the clip is oriented vertically, as shown by arrows 45, indicating flow paths in FIGS. 12 and 13. This orientation is preferred when the clip 600 is in a closed position. The third channel 642 is shown as larger than the third channel 242 to direct more fluid through exit aperture 620. The third channel 642 and fourth channel 643 each extend around the frame 610 thereby forming respective channels 642, 643 that extend substantially a length of the clip 600. It will be appreciated that the clip 600 may comprise a single channel, two channels, three channels, four channels or more, but preferably comprises four channels as shown.

Figure 12:
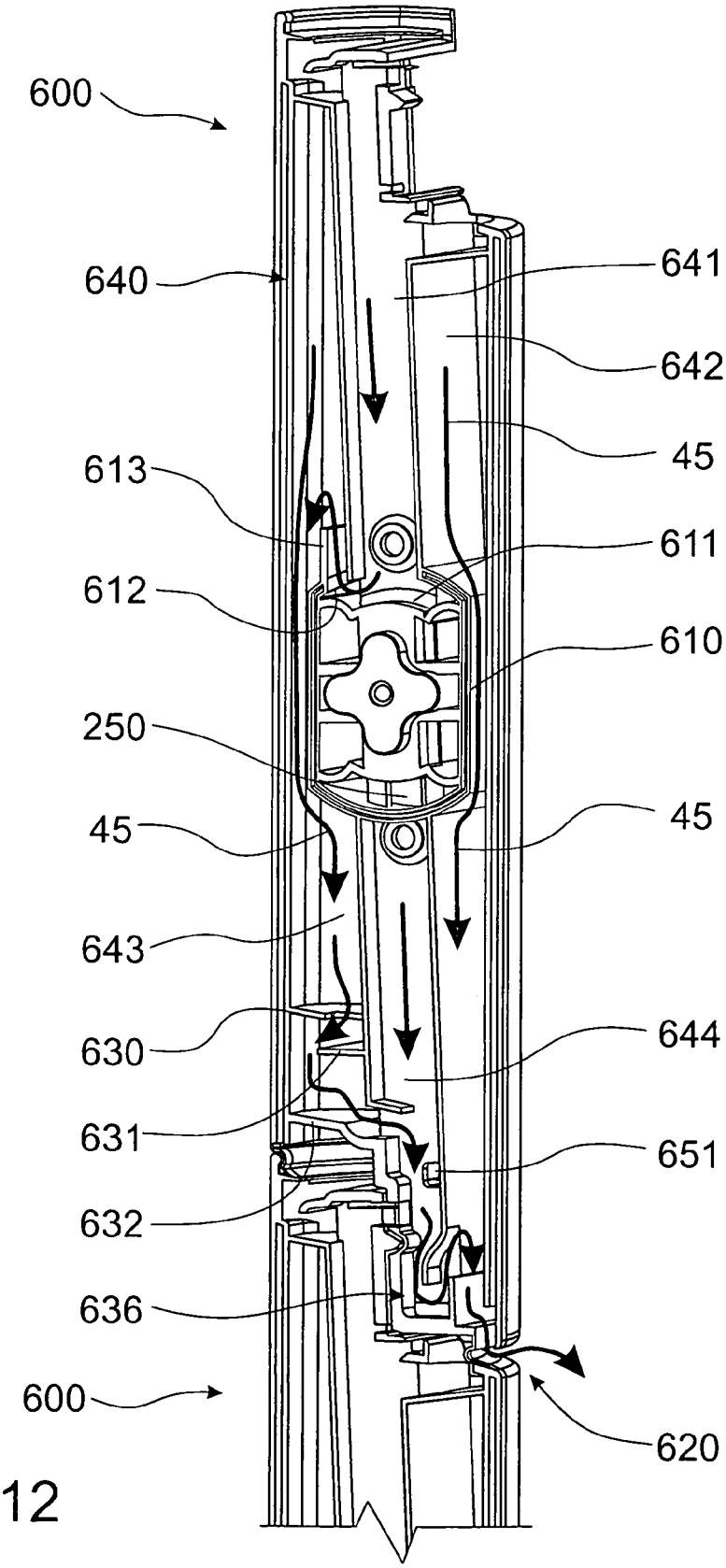
FIG. 12 is a close up of FIG. 11 with arrows indicating direction of water flow paths when the clips are in a vertical orientation.
Figure 13:
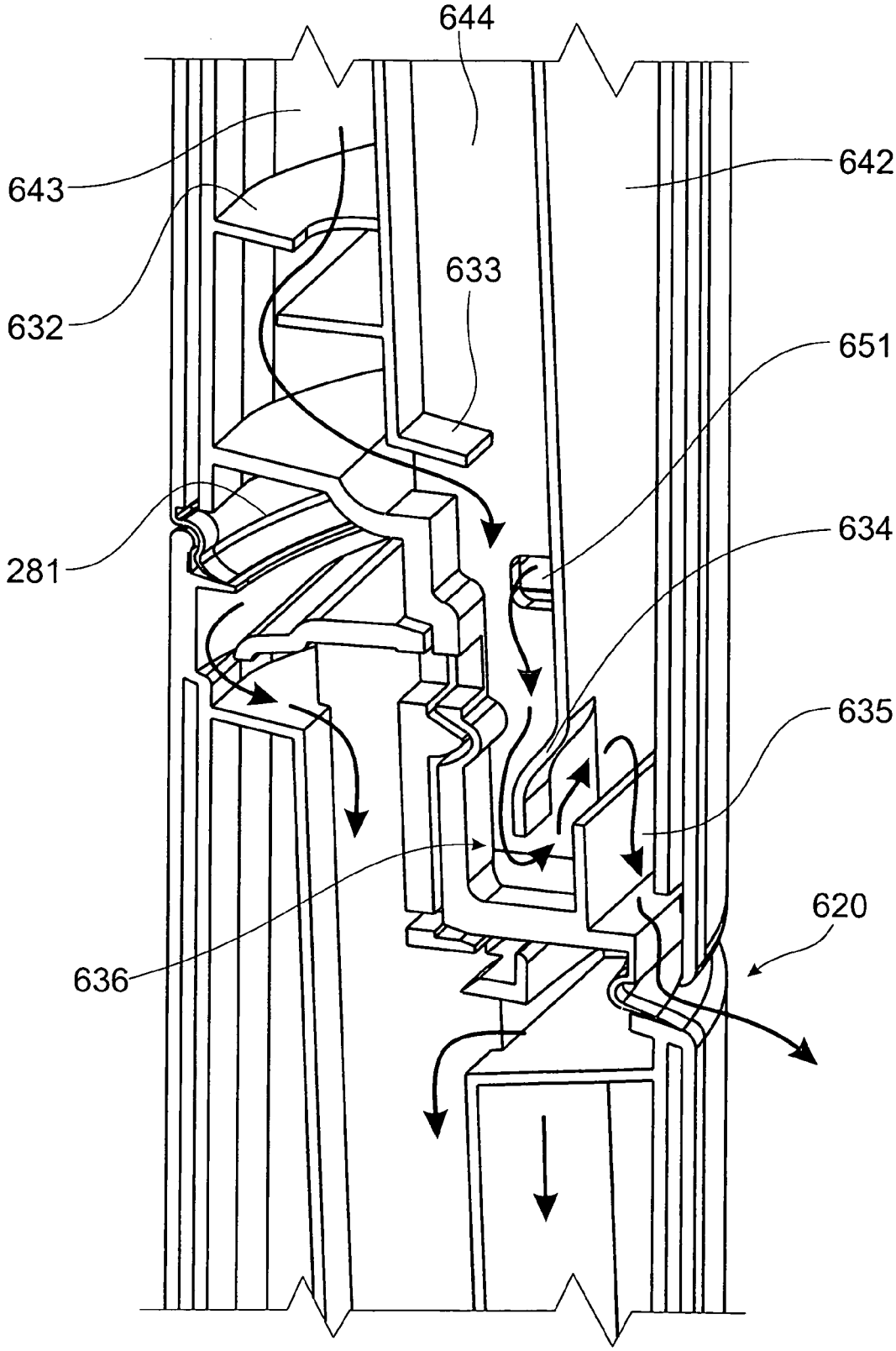
FIG. 13 is a close up of FIG. 12 with arrows indicating direction of fluid flow paths when the clip is in a vertical orientation.

The clip 600 also comprises flanges 630-635 for directing and slowing fluid movement within each channel 642, 643, 644 as shown in FIGS. 12 and 13, fluid movement is indicated by arrows. FIG. 13 shows a collection channel 636 that is capable of retaining a fluid. When the water fills the collection channel 636, the level of the fluid extends up to a top part of flange 635 such that a terminal end of flange 634 is submerged within the fluid. As the collection channel 636 is at a lowest end of the clip 600, the collection channel 636 will be a first location to fill with water flowing within the respective channel 642, 643, 644. This collection of water forms a seal or trap that prevents reverse flow of the fluid, e.g. air and/or water, into the second channel 644 and/or fourth channel 643 and accordingly directs flow of the fluid into the third channel 642 and out through exit aperture 620. Accordingly, the collection channel 636 seals channel 642 from the channel 644 and 643. An increase in air pressure, for example from air entering via exit aperture 620, will be equalized at channel 642, thereby assisting with flow of the fluid through exit aperture 620. Water filling the collection channel 636 flows over flange 635 and out through exit aperture 620.

As shown in FIGS. 11 and 12, wall 611 directs water though top drainage aperture 307 of the frame 300 in a similar manner as the previous embodiments, however, an additional overflow aperture 612 allows for excess fluid to flow over extension 613 and into fourth channel 643. Fluid in the fourth channel 643 ultimately exits the clip 600 from exit aperture 620.

Figure 14:
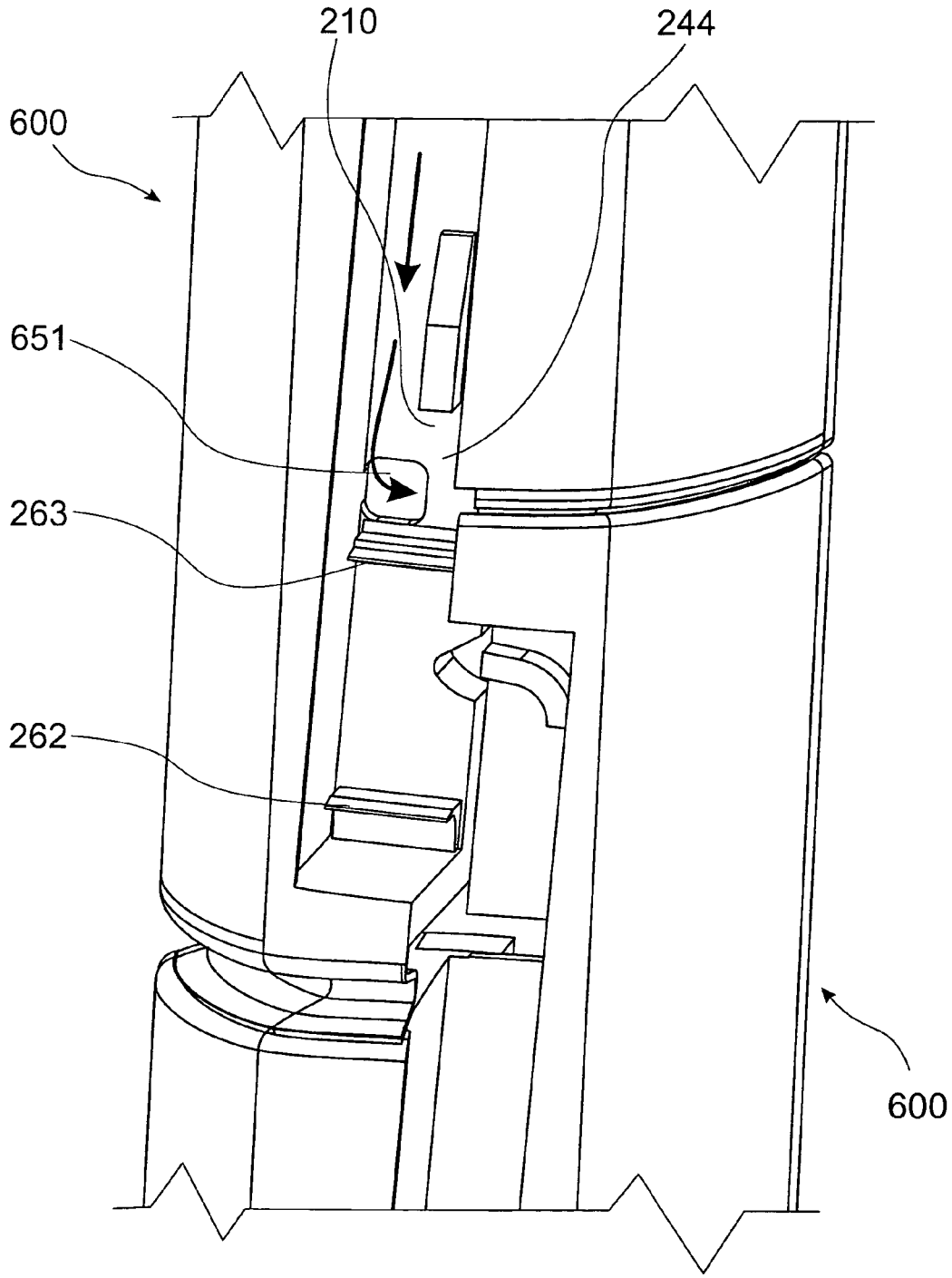
FIG. 14 is a close up of a front surface of the clip for an embodiment including a drainage aperture providing fluid communication with a channel located on the back surface of the clip.

FIG. 14 shows a front surface of the clip 600 comprising a recess 210 capable of receiving a plate 500. The recess 210 forms a fifth channel 244 in a similar manner as the previously described embodiments. However, an additional seal 263 is located adjacent to aperture 651 to direct fluid flowing longitudinally within the fifth channel 244 into the aperture 651 as shown by solid arrows. This flow of the fluid occurs preferably when the clip 600 is vertically orientated, for example when the clip 600 is in a closed position. The stop 263 and aperture 651 direct the fluid flowing through aperture 651 into the second channel 644 (see FIGS. 11-13). This prevents fluid from flowing between adjacent clips 600, which is different from the previous embodiments. The fifth channel 244 also preferably comprises an aperture 250 that is positioned adjacent to the aperture 308 of the frame 300 as described for the abovementioned embodiments when the clip 600 and frame 300 are longitudinally aligned. Accordingly, fluid located within the fifth channel 244 is directed into the frame 300 via aligned aperture 250 located on the clip 600 and aperture 308 located on the frame 300, and fluid also is directed into the second channel 644 via aperture 651.

It will be appreciated that the frame 300 may attach to a panel 350 that encloses the frame channel 310 to thereby retain water within the channel 310, as shown in FIG. 5. The frame 300 and panel 350 may be attached and sealed with a rubber or silicon type seal, an O-ring type seal, chemical seal or the like to prevent water from leaking out of the channel 310 at an undesired location.

It will be appreciated that the preferred embodiment of a clip shown in the drawings comprises four channels on the back surface of the clip, however, the back surface of the clip may comprise a single channel, two channels, four, five, six or another other suitable number of channels. Although it is preferred that respective second channel and first channel of adjacent clips and the fourth channel and first channel of adjacent clips are capable of fluid communication, other arrangements are contemplated wherein each respective first, second, third, fourth, fifth or more channels are each capable of fluid communication with each other. Also, in one embodiment, the third channel may preferably be capable of fluid communication with the first channel. Further, the clip 200 may comprise more than one channel on the front surface, for example, two or more channels.

The frame may include a single drainage aperture capable of fluid communication with both channels on the back surface of the clip and front surface of the clip. Further, the frame may include more than two apertures, for example, 3, 4, 5, 6 or more apertures capable of fluid communication with a single clip back surface and/or front surface.

The louvre system 100 may comprise any number of clips 200 or 600, and the number of clips 200 or 600 shown in the drawings are merely examples. The clip and frame assembly 100 preferably comprises a plurality of clips 200 or 600, for example, more than 2, 3, 4, 5, 6, 7, 8, 9, 10, 15, 20, 25, 30 or more clips. As described herein, preferably adjacent to each clip are apertures in the frame 300 to link channel(s) located on the back surface of the clip 200 and/or channel(s) located on the front surface of the clip 200 with the frame channel 310. This allows for exit of a fluid from within the channel(s) into the frame channel 310 to thereby reduce or prevent an increase in fluid pressure along a length of the clip and frame assembly 100.

The seals 260, 261, 262, 263 located within the recess 210 preferably comprise a flange as shown and made of a flexible material, preferably a resilient material. However, it will be appreciated that the seals 260, 261, 262, 263 may have other shapes and physical properties as long as the seals are capable of reducing or preventing water from passing thereby. The seals may be rubber, silicon, plastic, or other suitable material.

Preferably, the top and bottom drainage apertures 307, 308 comprise elongated slots as shown in the drawings to assist with directing water flow into the channel 310, however, the respective apertures 307, 308 may have other shapes, including for example, round, square, triangular and the like.

Damping members 265, 266, 267 shown in FIG. 4A function to dampen or disrupt air and/or water flow entering from openings 292, 293, 294, 295 at longitudinal ends 290, 291 of the clip 200. The air and/or water may enter openings 292, 293, 294, 295 from a gap between the clip 200 and frame 300.

The damping members 265, 266, 267 facilitate equalizing pressure within connecting channels 245, 246 between adjacent clips 200. The members 265, 266, 267 function to control water and/or air movement into and out of openings 292, 293, 294, 295 to thereby preferably reduce or prevent water from leaking to an interior side of the louvre 100. Members 265, 266, 267 also function as aesthetic shields that obstruct the openings 292, 293, 294, 295 when viewed from a longitudinal end 290, 291 of the clip 200 when the louvre 100 is in open position, but allows water to flow through the respective openings 292, 293, 294, 295 when the louvre 100 is in a closed position. Accordingly, the members 265, 266, 267 prevent unsightly "through" holes opening into the longitudinal ends of the clip as in the case of previously known clips.

The exterior seal 280 and interior seal 281 in combination with members 265, 266, 267 form connecting second-first channel 245 and connecting fourth-first channel 246, which are useful to prevent water penetration into the interior of the louvre 100.

The invention also relates to a method for directing fluid flow from a louvre clip to a frame channel of a louvre frame, including use of the features described above, for example use of an aperture in the frame located adjacent to each clip to direct the fluid into the frame channel, use of one or more channels on a back surface of the clip to direct water toward the aperture in the frame, one or more apertures located within a clip recess in fluid communication with the aperture on the frame to direct water from between a plate and clip and the like.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. A clip and frame assembly for a louvre window, the clip and frame assembly comprising:

a frame including at least one vertical frame member having a longitudinal frame channel which directs water within the vertical frame member and at least one first aperture through the vertical frame member into the frame channel; and a primary clip attachable to a louvre plate and rotatably coupled to the vertical frame member, a first channel located on a back surface of the primary clip which channels water longitudinally, and a second channel in the primary clip which channels water longitudinally; wherein the first channel, the first aperture and the frame channel define a flow path which directs water to flow from the first channel through the first aperture into and along the frame channel, when aligned in use, and the second channel directs water to an outer surface of the primary clip.

2. The clip and frame assembly of claim 1 wherein the first channel further includes an opening in an upper longitudinal end thereof.

3. The clip and frame assembly of claim 1 wherein the primary clip further includes a second channel, the second channel including an opening at a lower longitudinal end thereof remote from an opening of the first channel.

4. The clip and frame assembly of claim 1 further comprising a secondary clip rotationally coupled to the vertical frame member and located adjacent to the primary clip, both clips having a longitudinal alignment with each other and with the vertical frame member.

5. The clip and frame assembly of claim 4 wherein the secondary clip includes a first channel on its back surface including an opening at an upper longitudinal end with the opening in fluid communication with a corresponding lower opening of the second channel of the primary clip to provide, in use, a flow path from the second chamber to the first channel.

6. The clip and frame assembly of claim 4 wherein an opening of the second channel of the primary clip directs fluid to the outer surface of the primary clip.

7. The clip and frame assembly of claim 6 wherein the second channel of the primary clip and the first channel of the secondary clip are not in fluid communication.

8. The clip and frame assembly of claim 5 wherein the frame further includes an aperture for the first channel of the secondary clip, the aperture providing fluid communication between the first channel of the secondary clip and the frame channel.

9. The clip and frame assembly of claim 8 wherein each clip further is includes a third channel on its back surface, the third channel located adjacent to the first and second channels and towards an outer surface of the clip and in fluid communication with the first channel of the primary clip.

10. The clip and frame assembly of claim 9 further including a gap located between the frame and a wall separating the first and/or the second channel and the third channel and the gap dimensioned to allow formation of water surface tension between the frame and the wall when water is located therein.

11. The clip and frame assembly of claim 9 further comprising a fourth channel located adjacent to the first channel and/or the second channel and spaced from the third channel towards an inner surface of the clip.

12. The clip and frame assembly of claim 11 wherein a gap is provided between the frame and a wall separating the first and/or the second channels and the fourth channel, the gap dimensioned to allow formation of water surface tension between the frame and the wall when water is located therein.

13. The clip and frame assembly of claim 12 wherein the fourth channel of the primary clip and first chamber of the secondary clip are in fluid communication when the clips are longitudinally aligned.

14. The clip and frame assembly of claim 13 wherein a recess is provided on the front surface of each clip, the recess adapted to receive an edge of the louvre plate wherein the plate is spaced from a bottom surface of the recess to thereby define a fifth channel directs fluid longitudinally thereof.

15. The clip and frame assembly of claim 14 wherein the recess of each is clip includes a drainage aperture located on a bottom surface thereof and alignable with a second aperture located on the frame to provide a water flow path from the fifth channel through the drainage aperture and the second aperture into the frame channel in use.

16. The clip and frame assembly of claim 15 wherein the recess further comprises a seal located on the bottom surface thereof and adjacent to the drainage aperture, the seal directs fluid into the drainage aperture.

17. The clip and frame assembly of claim 16 wherein the clip further comprises a second drainage aperture located within the bottom surface of the recess, the second drainage aperture providing fluid communication between the fifth channel and the second chamber of the clip.

18. The clip and frame assembly of claim 17 further comprising a seal located on the bottom surface of the recess, positioned adjacent to the second drainage aperture and directs fluid into the second drainage aperture.

19. The clip and frame assembly of claim 18 wherein the recess of the clip includes an opening at each longitudinal end thereof wherein recesses of the primary clip and the secondary clip are in fluid communication through the openings when the clips are longitudinally aligned.

20. The clip and frame assembly of claim 8 comprising three or more clips wherein adjacent clips form a primary clip and a secondary clip pair.

21. The clip and frame assembly of claim 20 wherein each clip has fluid communication between its second chamber and a first chamber of an adjacent lower clip.

22. The clip and frame assembly of claim 21 wherein each clip has fluid communication between its fourth channel and the first channel of an adjacent lower clip.

23. The clip and frame assembly of claim 22 wherein the fifth channel of each clip is in fluid communication with the fifth channel of an adjacent clip.

24. The clip and frame assembly of claim 23 wherein each clip includes an exit aperture for providing a flow path for water external of the clip to an outer surface, the exit aperture preferably directing flow from the third channel.

25. The clip and frame assembly of claim 24 further comprising one or both of a seal or trap located in the flow path, one or more damping members in the channels and split edges of the clip.

26. A louvre system comprising:

a pair of frames; and a plurality of paired primary clips and secondary clips mounted to respective frames, the primary clip and secondary clip pairs each supporting a respective plate wherein the primary clips, secondary clips and frames are as claimed in claim 4.

27. The clip and frame assembly of claim 1 wherein the frame includes:

the vertical frame member;

a rotational member rotatably coupled to the vertical frame member and coupled to the clip;

a first arm attached to the rotational member;

a second arm attached to the rotational member at a location separate from the first arm;

a third arm coupled at one end to the first arm;

a handle coupled at one end to the third arm at a location intermediate ends of the second arm; and a bias member coupled at one end to the third arm and handle and coupled at an opposite end to the first arm;

wherein:

in an open position the third arm and bias member are substantially parallel to the first arm and, in a closed position, the third arm is rotated in a direction towards the second arm around a point whereat the first arm is coupled to the third arm thereby extending the bias member.

28. The clip and frame assembly of claim 27 wherein the frame further comprises a plurality of rotational members coupled to the first and second arms in similar manner to the rotational member.

29. The clip and frame assembly of claim 28 wherein the first arm and second arm are coupled to the rotational members such that rotation of the rotational member moves the first and second arms longitudinally in opposite directions.

30. The clip and frame assembly of claim 29 wherein the bias member is extended to provide a retracting force to pull the handle towards the first arm thereby retaining the clip and frame assembly in the closed position.

31. The clip and frame assembly of claim 30 further comprising a plate coupled to each clip, each plate in turn coupled to a clip at its opposite end.

32. A method of draining water from one or more louvre clips using the clip and frame assembly of claim 1, the method comprising the steps of:

channelling water along the first channel located on the back surface of each of the louvre clips; directing the water through the first aperture in the vertical frame member and into and along the frame channel in the vertical frame member supporting the louvre clip.

33. The method of claim 32 further including the step of directing water from the second channel or more other channels into the first channel.

34. The method of claim 32 further including the step of channelling water from an adjacent upper louvre clip into the first channel.

35. The method of claim 34 further including the step of directing water from the second channel or more other channels externally to an outer surface of the clip.

36. The method of claim 32 further including the step of channelling water from a channel formed by a recess adapted to receive the louvre plate and a plate edge, the water channelled through a second aperture and into the frame channel.

* * * * *

UNITED STATES PATENT AND TRADEMARK OFFICE

CERTIFICATE OF CORRECTION

PATENT NO. : 8,156,688 B2
APPLICATION NO. : 11/356520
DATED : April 17, 2012
INVENTOR(S) : Kok Boon Tan It is certified that error appears in the above-identified patent and that said Letters Patent is hereby corrected as shown below:

In the Claims:

Column 14, line 63, Claim 5, delete “chamber” and insert --channel--

Signed and Sealed this
Seventeenth Day of July, 2012

David J. Kappos

David J. Kappos
*Director of the United States Patent and Trademark Office*